US009873849B2

(12) United States Patent
Culley et al.

(10) Patent No.: US 9,873,849 B2
(45) Date of Patent: Jan. 23, 2018

(54) DIALKYAMINOALKANOL FRICTION MODIFIERS FOR FUELS AND LUBRICANTS

(71) Applicant: Afton Chemical Corporation, Richmond, VA (US)

(72) Inventors: Scott A. Culley, Midlothian, VA (US); Xinggao Fang, Midlothian, VA (US); Scott D. Schwab, Richmond, VA (US)

(73) Assignee: Afton Chemical Corporation, Richmond, VA (US)

( * ) Notice: Subject to any disclaimer, the term of this patent is extended or adjusted under 35 U.S.C. 154(b) by 0 days.

(21) Appl. No.: 14/964,761

(22) Filed: Dec. 10, 2015

(65) Prior Publication Data

US 2017/0166826 A1 Jun. 15, 2017

(51) Int. Cl.

| | |
|---|---|
| ***C10L 1/22*** | (2006.01) |
| ***C10L 1/23*** | (2006.01) |
| ***C10L 1/2387*** | (2006.01) |
| ***C10L 10/08*** | (2006.01) |
| ***C10L 1/222*** | (2006.01) |
| ***C10M 133/08*** | (2006.01) |
| ***C10L 1/02*** | (2006.01) |

(52) U.S. Cl.

CPC ..... *C10L 10/08* (2013.01); *C10L 1/023* (2013.01); *C10L 1/2225* (2013.01); *C10M 133/08* (2013.01); *C10L 2200/0259* (2013.01); *C10L 2200/0423* (2013.01); *C10L 2230/22* (2013.01); *C10L 2270/023* (2013.01); *C10M 2215/042* (2013.01); *C10N 2230/06* (2013.01); *C10N 2230/54* (2013.01); *C10N 2240/04* (2013.01); *C10N 2240/10* (2013.01); *C10N 2240/104* (2013.01); *C10N 2240/12* (2013.01)

(58) Field of Classification Search

CPC .. C10L 10/08; C10L 1/2225; C10L 2270/023; C10L 2200/0423; C10L 1/023; C10L 2200/0259; C10L 2230/22; C10M 133/08; C10M 2215/042; C10N 2240/10; C10N 2230/54; C10N 2240/04; C10N 2240/104; C10N 2240/12; C10N 2230/06

See application file for complete search history.

(56) References Cited

U.S. PATENT DOCUMENTS

| | | | | |
|---|---|---|---|---|
| 3,115,400 A | | 12/1963 | Marsh et al. | |
| 3,372,009 A | * | 3/1968 | Waldmann | C10L 1/2225 44/434 |
| 3,629,119 A | * | 12/1971 | Weaver | B01F 17/0085 252/77 |
| 3,976,441 A | * | 8/1976 | Bialy | C10L 1/2225 252/392 |
| 4,070,531 A | | 1/1978 | Schwarze et al. | |
| 4,231,883 A | | 11/1980 | Malec | |
| 4,409,000 A | | 10/1983 | LeSeur | |
| 4,549,885 A | | 10/1985 | Knapp | |
| 4,816,037 A | * | 3/1989 | Horodysky | C10L 1/2225 44/434 |
| 4,836,829 A | * | 6/1989 | Zimmerman | C10L 1/14 44/370 |
| 6,750,185 B2 | | 6/2004 | Ryu et al. | |
| 7,618,929 B2 | | 11/2009 | Tipton et al. | |
| 2005/0192185 A1 | | 9/2005 | Saathoff et al. | |
| 2011/0065619 A1 | | 3/2011 | Russo | |

FOREIGN PATENT DOCUMENTS

| | | | | |
|---|---|---|---|---|
| EP | 0919605 | | 6/1999 | |
| JP | 2003221588 | A1 | 8/2003 | |
| WO | WO 9416040 | A1 * | 7/1994 | C07D 251/34 |
| WO | 2007121205 | | 10/2007 | |

OTHER PUBLICATIONS

EIC Search Dec. 5, 2016.*

EIC Search 12/7/16.*

Splitter, et al.; Direct Measurement and Chemical Speciation of Top Ring Zone Liquid During Engine Operation; SAE Technical Paper 2015-01-0741, published Apr. 14, 2015.

Extended European Search Report for corresponding European Application No. 16203061.3 dated Apr. 12, 2017.

* cited by examiner

*Primary Examiner* — Pamela H Weiss

(74) *Attorney, Agent, or Firm* — Honigman Miller Schwartz & Cohn LLP; Jeffrey A. Chelstrom; Jonathan P. O'Brien

(57) ABSTRACT

A fuel composition, a lubricant composition, and methods for reducing friction or wear of moving parts. The fuel composition includes gasoline and from about 10 to about 500 ppm by weight of a dialkylaminoalkanol of the formula $R^1(R^2)NCH_2CH(R^3)R^4$. The lubricant composition includes base oil of lubricating viscosity and from about 0.05 to about 5.0 weight percent of a dialkylaminoalkanol of the formula $R^1(R^2)NCH_2CH(R^3)R^4$. In the above formulas wherein $R^1$ is an alkyl group or a hydroxyalkyl group containing from 8 to 50 carbon atoms; $R^2$ is an alkyl group containing from 1 to 4 carbon atoms; $R^3$ is selected from H and OH; and $R^4$ is selected from H, an alkyl group containing from 1 to 4 carbon atoms, and $CH_2OH$ and wherein at least one of $R^3$ and $R^4$ contains a hydroxyl group and provided that when $R^1$ is a hydroxyalkyl group, $R^3$ is OH and $R^4$ is $CH_2OH$.

4 Claims, No Drawings

DIALKYAMINOALKANOL FRICTION MODIFIERS FOR FUELS AND LUBRICANTS

TECHNICAL FIELD

The disclosure is directed to a gasoline fuel and/or lubricant composition that is effective to reduce engine friction or wear and thus improves fuel economy. In particular, the disclosure relates to certain dialkylaminoalkanol friction modifiers that reduce friction or wear of engine parts and improve fuel economy of an engine.

BACKGROUND AND SUMMARY

Fuel and lubricant compositions for vehicles are continually being improved to enhance various properties of the fuels and lubricants in order to accommodate their use in newer, more advanced engines, such as direct injection gasoline engines. Accordingly, fuel and lubricants compositions typically include additives that are directed to certain properties that require improvement. For example, friction modifiers (FM), such as fatty acid amides, are added to fuel to reduce friction and wear in the fuel delivery systems of an engine. When such additives are added to the fuel rather than the lubricant, a portion of the additives are transferred into the lubricant in the engine piston ring zone where it may reduce friction and wear and thus improve fuel economy. While such additives may be beneficially added to the lubricant rather than the fuel, such additive are not effective for improving lubricity and reducing wear in fuel delivery systems when added to the lubricant. Such fuel additives may be passed into the oil sump during engine operation, so that a fuel additive that is also beneficial to the engine lubricant is desirable. Accordingly, it is advantageous to include additives in fuels to provide both improved fuel delivery system wear protection as well as improved fuel economy.

Partial esters of fatty acid and polyhydroxy alcohols such as glycerol monooleate (GMO) are known as friction modifiers for fuel and lubricant compositions. Likewise, fatty acid derived amides are also well known friction modifiers. While GMO and some fatty amide friction modifiers may improve fuel economy when added to a fuel or lubricant, the fuel economy improvement may be less than desirable or those friction modifiers may cause an increase in intake valve deposits in gasoline engines. Accordingly, GMO and fatty amide friction modifiers cannot be beneficially added to a fuel composition to reduce the friction and improve the wear protection of the fuel delivery system without the risk of harmful and undesirable side effects.

Fatty amine diethoxylates and alkylaminodiols are also known as fuel and lubricant FMs that may reduce fuel consumption. For example, U.S. Pat. No. 4,231,883 discloses alkoxylated alkylamines that are useful for reducing friction in an engine lubricant. U.S. Pat. No. 4,816,037 discloses long chain alkylaminodiols that are useful for reducing friction for fuels or lubricants. U.S. Pat. No. 7,618,929 discloses long chain alkylaminodiols that are useful in reducing friction in transmission fluids. The aforementioned additives are tertiary amines that have either one or two hydrophobic long chain alkyl groups attached to nitrogen that give the friction modifier solubility in hydrocarbon fuels and oils. The aforementioned additives also have hydrophilic hydroxyamine groups, with either a vicinal diol or a bis-2-hydroxyethyl group that allows the friction modifiers to attach to metal surfaces. While these types of additives can reduce friction and wear there is still a need for friction modifiers with improved wear protection and greater friction reductions. Surprisingly, it has been found that certain dialkyaminoalkanols can reduce friction and wear more effectively than the previously known fatty amine diethoxylates and alkylaminodiols.

In accordance with the disclosure, exemplary embodiments provide a fuel composition, a lubricant composition, and methods for reducing friction or wear of moving parts. In some embodiments, the moving parts include, but are not limited to, moving parts of an engine, gear, compressor, turbine, transmission, tractor, hydraulic system, brake system, drive train, and the like.

In one embodiment, the fuel composition includes gasoline and from about 10 to about 750 ppm by weight based on a total weight of the fuel composition of a dialkylaminoalkanol of the formula $$R^1(R^2)NCH_2CH(R^3)R^4$$

wherein $R^1$ is an alkyl group or a hydroxyalkyl group containing from 8 to 50 carbon atoms; $R^2$ is an alkyl group containing from 1 to 4 carbon atoms; $R^3$ is selected from H and OH; and $R^4$ is selected from H, an alkyl group containing from 1 to 4 carbon atoms, and $CH_2OH$, provided that at least one of $R^3$ and $R^4$ contains a hydroxyl group and provided that when $R^1$ is a hydroxyalkyl group, $R^3$ is OH and $R^4$ is $CH_2OH$.

In another embodiment of the disclosure, there is provided a fuel composition for reducing friction or wear and improving engine fuel economy. The fuel composition includes gasoline and from about 10 to about 750 ppm by weight based on a total weight of the fuel composition of a dialkylaminoalkanol of the formula $$R^1(R^2)NCH_2CH(OH)R^4$$

wherein $R^1$ is an alkyl group or a hydroxyalkyl group containing from 8 to 50 carbon atoms; $R^2$ is an alkyl group contacting from 1 to 4 carbon atoms; and $R^4$ is $CH_2OH$.

In a further embodiment, there is provided a method for reducing friction or wear in an engine. The method includes fueling the engine with a fuel composition that includes gasoline and from about 10 to about 500 ppm by weight based on a total weight of the fuel composition of a dialkylaminoalkanol of the formula $$R^1(R^2)NCH_2CH(R^3)R^4$$

wherein $R^1$ is an alkyl group or a hydroxyalkyl group containing from 8 to 50 carbon atoms; $R^2$ is an alkyl group containing from 1 to 4 carbon atoms; $R^3$ is selected from H and OH; and $R^4$ is selected from H, an alkyl group containing from 1 to 4 carbon atoms, and $CH_2OH$, provided that at least one of $R^3$ and $R^4$ contains a hydroxyl group and provided that when $R^1$ is a hydroxyalkyl group, $R^3$ is OH and $R^4$ is $CH_2OH$.

Another embodiment of the disclosure provides a lubricant composition for reducing friction or wear. The lubricant composition includes a base oil of lubricating viscosity and from about 0.05 to about 5.0 weight percent based on a total weight of the lubricant composition of a dialkylaminoalkanol of the formula $$R^1(R^2)NCH_2CH(R^3)R^4$$

wherein $R^1$ is an alkyl group or a hydroxyalkyl group containing from 8 to 50 carbon atoms; $R^2$ is an alkyl group containing from 1 to 4 carbon atoms; $R^3$ is selected from the group consisting of H and OH; and $R^4$ is selected from the group consisting of H, an alkyl group containing from 1 to 4 carbon atoms, and $CH_2OH$, provided that at least one of $R^3$ and $R^4$ contains a hydroxyl group and provided that when $R^1$ is a hydroxyalkyl group, $R^3$ is OH and $R^4$ is $CH_2OH$.

A further embodiment of the disclosure provides a method for reducing wear in moving parts of an engine, transmission, turbine, gear or compressor. The method includes providing a lubricant composition that contains a base oil of lubricating viscosity and from about 0.05 to about 5.0 wt. % based on a total weight of the lubricant composition of a dialkylaminoalkanol of the formula $$R^1(R^2)NCH_2CH(R^3)R^4$$

wherein $R^1$ is an alkyl group or a hydroxyalkyl group containing from 8 to 50 carbon atoms; $R^2$ is an alkyl group containing from 1 to 4 carbon atoms; $R^3$ is selected from the group consisting of H and OH; and $R^4$ is selected from the group consisting of H, an alkyl group containing from 1 to 4 carbon atoms, and $CH_2OH$, provided that at least one of $R^3$ and $R^4$ contains a hydroxyl group and provided that when $R^1$ is a hydroxyalkyl group, $R^3$ is OH and $R^4$ is $CH_2OH$. The engine, transmission, turbine, gear or compressor is operated on the lubricant composition, whereby friction or wear in the engine, transmission, turbine, gear or compressor is reduced compared to friction or wear in the engine, transmission, turbine, gear or compressor operated with a conventional friction modifier.

An advantage of the compositions and methods described herein is that the additive for the fuel or lubricant may not only improve the friction and wear properties of the fuel or lubricant composition, but the additive may also be effective to improve fuel economy of an engine operated on the fuel or lubricant.

In a further embodiment, the fuel composition contains from about 10 to about 750 ppm by weight, such as from 20 to about 500 ppm by weight, or from 30 to about 250 ppm by weight of the reaction product based on a total weight of the fuel composition.

In another embodiment, an oil of lubricating viscosity contains from 0.05 to 5.0 wt. %, such as from 0.1 to 2.0 wt. %, or 0.15 to 0.5 wt. % of reaction product based on the total weight of the oil composition.

Additional embodiments and advantages of the disclosure will be set forth in part in the detailed description which follows, and/or can be learned by practice of the disclosure. It is to be understood that both the foregoing general description and the following detailed description are exemplary and explanatory only and are not restrictive of the disclosure, as claimed.

DETAILED DESCRIPTION OF EXEMPLARY EMBODIMENTS

The fuel additive component of the present application may be used in a minor amount in a major amount of fuel and may be added to the fuel directly or added as a component of an additive concentrate to the fuel. In the alternative, the additive may be added to an oil of lubricating viscosity or may be incorporated in the lubricant for an engine from a fuel containing the additive from the combustion of the fuel in the engine.

A suitable fuel or lubricant additive component for improving the operation of mechanical devices described herein may be made by reacting a secondary amine with an alkyl epoxide such as ethylene oxide, glycidol or a glycidyl ether at a temperature ranging from about 50° C. to about 150° C., such as from about 60° C. to about 100° C. In an alternative embodiment, the additive component describe herein may be made by reacting a secondary amine with a halogen substituted alkanol such as 3-choloropropane-1,2-diol or a halogen-substituted epoxide such as 1-chloro-2,3-epoxypropane. Alternatively, an alkyl halide, such as an alkyl bromide may be reacted with an alkylaminoalkanol or alkylaminoalkyldiol. Other methods known to those skilled in the art may be used to make the dialkylaminoalkanol compounds described herein. In the embodiment wherein the dialkylaminoalkanol comprises a hydroxyalkyl group containing from 8 to 50 carbon atoms, the additive component may be made by reacting an alkylaminoalkanol or alkylaminodiol with a hydrocarbyl epoxide wherein hydrocarbyl epoxide has an alkyl group containing from 8 to 50 carbon atoms.

The term "TBN" as employed herein is used to denote the Total Base Number in mg KOH/g as measured by the method of ASTM D2896 or ASTM D4739.

The term "alkyl" as employed herein refers to straight, branched, cyclic, and/or substituted saturated chain moieties of from about 1 to about 100 carbon atoms.

The term "alkenyl" as employed herein refers to straight, branched, cyclic, and/or substituted unsaturated chain moieties of from about 3 to about 10 carbon atoms.

The term "aryl" as employed herein refers to single and multi-ring aromatic compounds that may include alkyl, alkenyl, alkylaryl, amino, hydroxyl, alkoxy, halo substituents, and/or heteroatoms including, but not limited to, nitrogen, oxygen, and sulfur.

As used herein, the term "hydrocarbyl group" or "hydrocarbyl" is used in its ordinary sense, which is well-known to those skilled in the art. Specifically, it refers to a group having a carbon atom directly attached to the remainder of a molecule and having a predominantly hydrocarbon character. Examples of hydrocarbyl groups include:

(1) hydrocarbon substituents, that is, aliphatic (e.g., alkyl or alkenyl), alicyclic (e.g., cycloalkyl, cycloalkenyl) substituents, and aromatic-, aliphatic-, and alicyclic-substitutedaromatic substituents, as well as cyclic substituents wherein the ring is completed through another portion of the molecule (e.g., two substituents together form an alicyclic radical);

(2) substituted hydrocarbon substituents, that is, substituents containing non-hydrocarbon groups which, in the context of the description herein, do not alter the predominantly hydrocarbon substituent (e.g., halo (especially chloro and fluoro), hydroxy, alkoxy, mercapto, alkylmercapto, nitro, nitroso, amino, alkylamino, and sulfoxy);

(3) hetero-substituents, that is, substituents which, while having a predominantly hydrocarbon character, in the context of this description, contain other than carbon in a ring or chain otherwise composed of carbon atoms. Hetero-atoms include sulfur, oxygen, nitrogen, and encompass substituents such as pyridyl, furyl, thienyl, and imidazolyl. In general, no more than two, or as a further example, no more than one, non-hydrocarbon substituent will be present for every ten carbon atoms in the hydrocarbyl group; in some embodiments, there will be no non-hydrocarbon substituent in the hydrocarbyl group.

As used herein, the terms "lubricant," "lubricant composition," "lubricating composition," "lubricating oil," and the like include functional fluids as well as fluids that are suitable for use in crankcases of internal combustion engines. Lubricants typically include a base oil and an additive package specifically designed for a particular application.

Internal combustion engine types may include, but are not limited to heavy duty diesel, passenger car, light duty diesel, medium speed diesel, or marine engines. An internal combustion engine may be a diesel fueled engine, a gasoline fueled engine, a natural gas fueled engine, a bio-fueled engine, a mixed diesel/biofuel fueled engine, a mixed gasoline/biofuel fueled engine, an alcohol fueled engine, a mixed gasoline/alcohol fueled engine, a compressed natural gas (CNG) fueled engine, or mixtures thereof. An internal combustion engine may also be used in combination with an electrical or battery source of power. An engine so configured is commonly known as a hybrid engine. The internal combustion engine may be a 2-stroke, 4-stroke, or rotary engine. Suitable internal combustion engines include marine diesel engines, aviation piston engines, low-load diesel engines, and motorcycle, automobile, locomotive, and truck engines.

"Functional fluids" encompass a variety of fluids including but not limited to hydraulic fluids, power transmission fluids including automatic transmission fluids, continuously variable transmission fluids and manual transmission fluids, tractor hydraulic fluids, gear oils, axle oils, power steering fluids, fluids used in wind turbines, compressors, some industrial fluids, tractor fluids, and fluids related to power train components. It should be noted that within each of these fluids such as, for example, automatic transmission fluids, there are a variety of different types of fluids due to the various transmissions having different designs which have led to the need for fluids of markedly different functional characteristics.

As used herein, the term "major amount" is understood to mean an amount greater than or equal to 50 wt. %, for example from about 80 to about 98 wt. % relative to the total weight of the composition. Moreover, as used herein, the term "minor amount" is understood to mean an amount less than 50 wt. % relative to the total weight of the composition.

Amine Compound

According to the disclosure, the amine compounds used to make the dialkylaminoalkanol compounds described herein are secondary fatty amines selected from the group consisting of amines of the formula

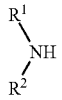

wherein $R^1$ is an alkyl group containing from 6 to 50 carbon atoms, such as from 8 to 22 carbon atoms, and mixtures thereof, and $R^2$ is an alkyl group containing from 1 to 4 carbon atoms and mixtures thereof. Suitable amines include, but are not limited to N-methylhexylamine, N-ethylhexylamine, N-propylhexylamine, N-isopropylhexylamine N-butylhexylamine, N-isobutylhexylamine, N-t-butylhexylamine, N-methyloctylamine, N-ethyloctylamine, N-propyloctylamine, N-isopropyloctylamine N-butyloctylamine, N-isobutyloctylamine, N-t-butyloctylamine, N-methylnonylamine, N-ethylnonylamine, N-propylnonylamine, N-isopropylnonylamine N-butylnonylamine, N-isobutylnonylamine, N-t-butylnonylamine, N-methyldecylamine, N-ethyldecylamine, N-propyldecylamine, N-isopropyldecylamine N-butyldecylamine, N-isobutyldecylamine, N-t-butyldecylamine, N-methyldodecylamine, N-ethyldodecylamine, N-propyldodecylamine, N-isopropyldodecylamine N-butyldodecylamine, N-isobutyldodecylamine, N-t-butyldodecylamine, N-methyloctadecylamine, N-ethyloctadecylamine, N-propyloctadecylamine, N-isopropyloctadecylamine N-butyloctadecylamine, N-isobutyloctadecylamine, N-t-butyloctadecylamine, Epoxide A suitable epoxide may be selected from the group consisting hydrocarbyl epoxides of the formula:

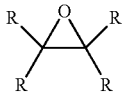

wherein each R is independently selected from H and a $C_1$ to $C_{50}$ hydrocarbyl group, and polyepoxides. Non-limiting examples of suitable epoxides that may be used as reactants may be selected from the group consisting of:

1,3-Butadiene diepoxide
Cyclohexene oxide
Cyclopentene oxide
Dicyclopentadiene dioxide
1,2,5,6-Diepoxycyclooctane
1,2,7,8-Diepoxyoctane
1,2-Epoxybutane
cis-2,3-Epoxybutane
3,4-Epoxy-1-butene
3,4-Epoxycyclohexylmethyl 3,4-epoxycyclohexanecarboxylate
1,2-Epoxydodecane
1,2-Epoxyhexadecane
1,2-Epoxyhexane
1,2-Epoxy-5-hexene
1,2-Epoxy-2-methylpropane
exo-2,3-Epoxynorbornane
1,2-Epoxyoctane
1,2-Epoxypentane
1,2-Epoxy-3-phenoxypropane
(2,3-Epoxypropyl)benzene
N-(2,3-Epoxypropyl)phthalimide
1,2-Epoxytetradecane
exo-3,6-Epoxy-1,2,3,6-tetrahydrophthalic anhydride
3,4-Epoxytetrahydrothiophene-1,1-dioxide
Isophorone oxide
Methyl-1,2-cyclopentene oxide
2-Methyl-2-vinyl oxirane
α-Pinene oxide
Ethylene oxide
propylene oxide
Polyisobutene oxide
cis-Stilbene oxide
Styrene oxide
Glycidol
Glycidyl ethers
Tetracyanoethylene oxide
Tris(2,3-epoxypropyl) isocyanurate and combinations of two or more of the foregoing. A particularly suitable epoxide may be selected from ethylene oxide, propylene oxide, butylenes oxide, glycidol, and alkyl glycidyl ethers.

The dialkylaminoalkanol compounds from the foregoing secondary amine and epoxide may be made by reacting a secondary amine with and epoxide such as glycidol or an alkyl glycidyl ether at an elevated temperature. Accordingly, the reaction of amine and epoxide may be carried out at temperature ranging from about 50° C. to about 150° C., for example from about 60° C. to about 100° C. A mole ratio of amine to epoxide may range from about 1.1:0.9 to about 0.9:1.1. As an alternative to using an epoxide, the dialkylaminoalkanol compounds may also be made by reacting a secondary amine with an alkoxy halide, such as 3-chloropropane-1,2-diol or a halogen-substituted epoxide such as 1-chloro-2,3-epoxypropane (epichlorohydrin) at an elevated temperature.

In an alternative embodiment, the dialkylaminoalkanol may be made by reacting a secondary alkylaminoalkanol or alkylaminodiol with an alkyl halide. The alkylhalide may be selected from $C_8$ to $C_{50}$ alkyl bromides, chlorides, iodides and the like with the foregoing mole ratios of reactants and at the temperatures indicated above.

In the embodiment wherein the dialkylaminoalkanol comprises N-(2-hydroxyalkyl)amino groups containing from 8 to 50 carbon atoms, the additive component can be made by reacting a monoalkylaminoalkanol or monoalkylaminodiol with a hydrocarbyl epoxide wherein the hydrocarbyl epoxide has an alkyl group containing from 8 to 50 carbon atoms. Accordingly, the reaction of amine and epoxide may be carried out at temperature ranging from about 50° C. to about 150° C., for example from about 60° C. to about 100° C. Alternatively, the product may be prepared as described in U.S. Pat. No. 4,070,531.

Of the foregoing dialkylaminoalkanol compounds, particularly suitable dialkylaminoalkanol compounds are compounds of the formulas $$R^1(R^2)NCH_2CH(R^3)R^4$$

$$R^1(R^2)NCH_2CH(OH)R^4$$

and $$R^1(R^2)NCH_2CH_2CH_2OH$$

wherein $R^1$ is an alkyl group or a hydroxyalkyl group containing from 8 to 50 carbon atoms; $R^2$ is an alkyl group containing from 1 to 4 carbon atoms; $R^3$ is selected from H and OH; and $R^4$ is selected from H, an alkyl group containing from 1 to 4 carbon atoms, and $CH_2OH$, provided that at least one of $R^3$ and $R^4$ contains a hydroxyl group and provided that when $R^1$ is a hydroxyalkyl group, $R^3$ is OH and $R^4$ is $CH_2OH$.

One or more additional optional compounds may be present in the fuel compositions of the disclosed embodiments. For example, the fuels may contain conventional quantities of octane improvers, corrosion inhibitors, cold flow improvers (CFPP additive), pour point depressants, solvents, demulsifiers, lubricity additives, additional friction modifiers, amine stabilizers, combustion improvers, dispersants, antioxidants, heat stabilizers, conductivity improvers, metal deactivators, carrier fluid, marker dyes, organic nitrate ignition accelerators, cyclomatic manganese tricarbonyl compounds, and the like. In some aspects, the compositions described herein may contain about 10 weight percent or less, or in other aspects, about 5 weight percent or less, based on the total weight of the additive concentrate, of one or more of the above additives. Similarly, the fuels may contain suitable amounts of conventional fuel blending components such as methanol, ethanol, dialkyl ethers, 2-ethylhexanol, and the like.

In one embodiment, a fuel additive package may contain the above described dialkylaminoalkanol additive in combination with a carrier fluid and other ingredients selected from fatty amine ethoxylates; one or more detergents selected from Mannich bases, polyalkylamines, polyalkylpolyamines, polyalkenyl succinimides, and quaternary ammonium salt detergents. Quaternary ammonium salt detergents may be selected from compounds of the formula

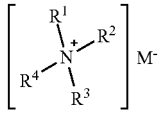

wherein each of $R^1$, $R^2$, $R^3$, and $R^4$ is selected from a hydrocarbyl group containing from 1 to 50 carbon atoms, wherein at least one and not more than three of $R^1$, $R^2$, $R^3$, and $R^4$ is a hydrocarbyl group containing from 1 to 4 carbon atoms and at least one of $R^1$, $R^2$, $R^3$, and $R^4$ is a hydrocarbyl group containing from 8 to 50 carbon atoms, $M^-$ is selected from the group consisting of carboxylates, nitrates, nitrides, nitrites, hyponitrites, phenates, carbamates, carbonates, and mixtures thereof, wherein the carboxylate is not an oxalate or formate; alkoxylated quaternary ammonium salts derived from epoxides, tertiary amines, and optional protonating agents; reaction products of amido amines or acylated amines containing at least one tertiary amino group and epoxides; reaction products of hydrocarbyl substituted anhydrides, tertiary amines and hydroxyl-containing epoxides; esterified quaternary ammonium salts derived from tertiary amines, epoxides, proton donors and anhydrides; reaction products of hydrocarbyl substituted compounds containing at least one tertiary amino group selected from $C_{10}$-$C_{30}$-alkyl or alkenyl-substituted amidopropyldimethylamines and $C_{12}$-$C_{200}$-alkyl or alkenyl-substituted succinic-carbonyldimethylamines and halogen substituted $C_2$-$C_8$ carboxylic acids, esters, amides, or salts thereof; and mixtures two or more of the foregoing detergents.

Suitable carrier fluids may be selected from any suitable carrier fluid that is compatible with the gasoline and is capable of dissolving or dispersing the components of the additive package. Typically, the carrier fluid is a hydrocarbon fluid, for example a petroleum or synthetic lubricating oil basestock including mineral oil, synthetic oils such as polyesters or polyethers or other polyols, or hydrocracked or hydroisomerised basestock. Alternatively, the carrier fluid may be a distillate boiling in the gasoline range. The amount of carrier fluid contained in the additive package may range from 10 to 80 wt %, preferably from 20 to 75 wt %, and more preferably from 30 to 60 wt % based on a total weight of the additive package. Such additive packages containing the dialkylaminoalkanol additive, detergent and carrier fluid were found to remain fluid even at temperatures as low as −20° C.

In some embodiments of this application, the additives may be employed in amounts sufficient to reduce friction and/or wear in a fuel system or combustion chamber of an engine and/or crankcase. For example, the gasoline fuels of this disclosure may contain, on an active ingredient basis, an amount of the dialkylaminoalkanol compound in the range of about 10 ppm to about 750 ppm by weight of dialkylaminoalkanol compound, such as in the range of about 20 ppm to about 500 ppm by weight or in the range of from about 30 ppm to about 320 ppm by weight of the dialkylaminoalkanol compound based on a total weight of the fuel composition. The active ingredient basis excludes the weight of (i) unreacted components associated with and remaining in the product as produced and used, and (ii) solvent(s), if any, used in the manufacture of the product either during or after its formation.

The additives of the present application, including the dialkylaminoalkanol compound described above, and optional additives used in formulating the fuels of this invention may be blended into the base fuel individually or in various sub-combinations. In some embodiments, the additive components of the present application may be blended into the fuel concurrently using an additive concentrate, as this takes advantage of the mutual compatibility and convenience afforded by the combination of ingredients when in the form of an additive concentrate. Also, use of a concentrate may reduce blending time and lessen the possibility of blending errors.

The fuels of the present application may be applicable to the operation of gasoline engines. The engine includes both stationary engines (e.g., engines used in electrical power generation installations, in pumping stations, etc.) and ambulatory engines (e.g., engines used as prime movers in automobiles, trucks, road-grading equipment, military vehicles, etc.).

In another embodiment, the dialkylaminoalkanol compound described herein may be used as a friction modifier in a lubricant composition. The lubricant composition may include a base oil selected from any of the base oils in Groups I-V as specified in the American Petroleum Institute (API) Base Oil Interchangeability Guidelines. The five base oil groups are as follows:

TABLE 1

| Base oil Category | Sulfur (%) | | Saturates (%) | Viscosity Index |
|---|---|---|---|---|
| Group I | >0.03 | and/or | <90 | 80 to 120 |
| Group II | ≤0.03 | and | ≥90 | 80 to 120 |
| Group III | ≤0.03 | and | ≥90 | ≥120 |
| Group IV | All polyalphaolefins (PAOs) | | | |
| Group V | All others not included in Groups I, II, III, or IV | | | |

Groups I, II, and III are mineral oil process stocks. Group IV base oils contain true synthetic molecular species, which are produced by polymerization of olefinically unsaturated hydrocarbons. Many Group V base oils are also true synthetic products and may include diesters, polyol esters, polyalkylene glycols, alkylated aromatics, polyphosphate esters, polyvinyl ethers, and/or polyphenyl ethers, and the like, but may also be naturally occurring oils, such as vegetable oils. It should be noted that although Group III base oils are derived from mineral oil, the rigorous processing that these fluids undergo causes their physical properties to be very similar to some true synthetics, such as PAOs. Therefore, oils derived from Group III base oils may be referred to as synthetic fluids in the industry.

The base oil used in the disclosed lubricating oil composition may be a mineral oil, animal oil, vegetable oil, synthetic oil, or mixtures thereof. Suitable oils may be derived from hydrocracking, hydrogenation, hydrofinishing, unrefined, refined, and re-refined oils, and mixtures thereof.

Unrefined oils are those derived from a natural, mineral, or synthetic source without or with little further purification treatment. Refined oils are similar to the unrefined oils except that they have been treated in one or more purification steps, which may result in the improvement of one or more properties. Examples of suitable purification techniques are solvent extraction, secondary distillation, acid or base extraction, filtration, percolation, and the like. Oils refined to the quality of an edible may or may not be useful. Edible oils may also be called white oils. In some embodiments, lubricant compositions are free of edible or white oils.

Re-refined oils are also known as reclaimed or reprocessed oils. These oils are obtained similarly to refined oils using the same or similar processes. Often these oils are additionally processed by techniques directed to removal of spent additives and oil breakdown products.

Mineral oils may include oils obtained by drilling or from plants and animals or any mixtures thereof. For example, such oils may include, but are not limited to, castor oil, lard oil, olive oil, peanut oil, corn oil, soybean oil, and linseed oil, as well as mineral lubricating oils, such as liquid petroleum oils and solvent-treated or acid-treated mineral lubricating oils of the paraffinic, naphthenic or mixed paraffinic-naphthenic types. Such oils may be partially or fully hydrogenated, if desired. Oils derived from coal or shale may also be useful.

Useful synthetic lubricating oils may include hydrocarbon oils such as polymerized, oligomerized, or interpolymerized olefins (e.g., polybutylenes, polypropylenes, propylene/isobutylene copolymers); poly(1-hexenes), poly(1-octenes), trimers or oligomers of 1-decene, e.g., poly(1-decenes), such materials being often referred to as α-olefins, and mixtures thereof; alkyl-benzenes (e.g. dodecylbenzenes, tetradecylbenzenes, dinonylbenzenes, di-(2-ethylhexyl)-benzenes); polyphenyls (e.g., biphenyls, terphenyls, alkylated polyphenyls); diphenyl alkanes, alkylated diphenyl alkanes, alkylated diphenyl ethers and alkylated diphenyl sulfides and the derivatives, analogs and homologs thereof or mixtures thereof. Polyalphaolefins are typically hydrogenated materials.

Other synthetic lubricating oils include polyol esters, diesters, liquid esters of phosphorus-containing acids (e.g., tricresyl phosphate, trioctyl phosphate, and the diethyl ester of decane phosphonic acid), or polymeric tetrahydrofurans. Synthetic oils may be produced by Fischer-Tropsch reactions and typically may be hydroisomerized Fischer-Tropsch hydrocarbons or waxes. In one embodiment oils may be prepared by a Fischer-Tropsch gas-to-liquid synthetic procedure as well as other gas-to-liquid oils.

The amount of the oil of lubricating viscosity present may be the balance remaining after subtracting from 100 wt % the sum of the amount of the performance additives inclusive of viscosity index improver(s) and/or pour point depressant(s) and/or other top treat additives. For example, the oil of lubricating viscosity that may be present in a finished fluid may be a major amount, such as greater than about 50 wt %, greater than about 60 wt %, greater than about 70 wt %, greater than about 80 wt %, greater than about 85 wt %, or greater than about 90 wt %.

The additive components that may be present in a lubricating oil composition may be selected from a variety of components including, but not limited to, antifoam agents, antioxidants, antiwear agents, ashless and ash-containing dispersants, corrosion inhibitors, metallic detergents, TBN boosters, seal swell agents, demulsifiers, emulsifiers, viscosity index improvers, antirust additives, metal deactivators, pour point depressants, air entrainment additives, additional ashless and ash-containing friction modifiers, and the like. Typically, a fully-formulated lubricating oil will contain one or more of the foregoing ingredients. Non-limiting examples of lubricant compositions according to the disclosure are given below.

In general terms, a suitable crankcase lubricant may include additive components in the ranges listed in the following table.

TABLE 2

| Component | Wt. % (Suitable Embodiments) | Wt. % (Suitable Embodiments) |
|---|---|---|
| Dispersant(s) | 0.1-10.0 | 1.0-5.0 |
| Antioxidant(s) | 0.01-5.0 | 0.1-3.0 |
| Detergent(s) | 0.1-15.0 | 0.2-8.0 |
| Ashless TBN booster(s) | 0.0-1.0 | 0.01-0.5 |
| Corrosion inhibitor(s) | 0.0-5.0 | 0.0-2.0 |
| Metal dihydrocarbyldithiophosphate(s) | 0.1-6.0 | 0.1-4.0 |
| Ash-free phosphorus compound(s) | 0.0-6.0 | 0.0-4.0 |
| Antifoaming agent(s) | 0.0-5.0 | 0.001-0.15 |
| Antiwear agent(s) | 0.0-1.0 | 0.0-0.8 |
| Pour point depressant(s) | 0.0-5.0 | 0.01-1.5 |
| Viscosity index improver(s) | 0.0-20.0 | 0.25-10.0 |
| Friction modifier(s) | 0.01-5.0 | 0.05-2.0 |
| Base oil(s) | Balance | Balance |
| Total | 100 | 100 |

The percentages of each component above represent the weight percent of each component, based upon the weight of the final lubricating oil composition. The remainder of the lubricating oil composition consists of one or more base oils.

Generally speaking, a tractor fluid may include a base oil and the following additional components. Respective amounts of additives may be blended into a selected base oil in amounts that may be sufficient to provide their expected performance. An effective amount for a specific formulation may be readily ascertained, but for illustrative purposes these general guides for representative effective amounts are provided. The amounts below are given in weight % of the fully formulated lubricating fluid.

TABLE 3

| Component | Wt. % (Suitable Embodiments) | Wt. % (Suitable Embodiments) |
|---|---|---|
| Dispersant(s) | 0.0-20.0 | 2.0-8.0 |
| Antioxidant(s) | 0.0-2.0 | 0.1-1.0 |
| Metal detergent(s) | 0.0-5.0 | 0.01-1.0 |
| Seal swell agent(s) | 0.0-10.0 | 0.5-5.0 |
| Corrosion inhibitor(s) | 0.0-5.0 | 0.05-2.0 |
| Extreme pressure/Antiwear agent(s) | 0.0-5.0 | 0.25-2.0 |
| Rust inhibitor | 0.0 1.0 | 0.05-0.50 |
| Antifoaming agent(s) | 0.0-0.5 | 0.001-0.10 |
| Viscosity index improver(s) | 0.0-30.0 | 5.0-15.0 |
| Friction modifier(s) | 0.0-10.0 | 0.05-5.0 |
| Base oil(s) | Balance | Balance |
| Total | 100 | 100 |

It will be appreciated that the individual components employed may be separately blended into the base fluid or may be blended therein in various sub-combinations, if desired. Moreover, such components may be blended in the form of separate solutions in a diluent. It may be preferable, however, to blend the additive components used in the form of a concentrate, as this simplifies the blending operations, reduces the likelihood of blending errors, and takes advantage of the compatibility and solubility characteristics afforded by the overall concentrate.

A transmission fluid may contain a base oil and the following additional components. Respective amounts of additives may be blended into a selected base oil in amounts that may be sufficient to provide their expected performance. An effective amount for a specific formulation may be readily ascertained, but for illustrative purposes these general guides for representative effective amounts are provided. The amounts below are given in weight % of the fully formulated lubricating fluid.

TABLE 4

| Component | Wt. % (Suitable Embodiments) | Wt. % (Suitable Embodiments) |
|---|---|---|
| Dispersant(s) | 0.5-20.0 | 1.0-15.0 |
| Antioxidant(s) | 0.0-2.0 | 0.01-1.0 |
| Metal detergent(s) | 0.1-10.0 | 0.5-5.0 |
| Seal swell agent(s) | 0.0-10.0 | 0.5-5.0 |
| Corrosion inhibitor(s) | 0.0-5.0 | 0.0-2.0 |
| Extreme Pressure/Antiwear agent(s) | 0.01-5.0 | 0.1-2.0 |
| Pour point depressant(s) | 0.001-1.0 | 0.01-0.5 |
| Antifoaming agent(s) | 0.0-1.0 | 0.001-0.1 |
| Viscosity index improver(s) | 0.0-30.0 | 5.0-15.0 |
| Friction modifier(s) | 0.0-5.0 | 0.05-2.0 |
| Base oil(s) | Balance | Balance |
| Total | 100 | 100 |

It will be appreciated that the individual components employed may be separately blended into the base fluid or may be blended therein in various sub-combinations, if desired. Ordinarily, the particular sequence of such blending steps is not crucial. Moreover, such components may be blended in the form of separate solutions in a diluent. It may be preferable, however, to blend the additive components used in the form of a concentrate, as this simplifies the blending operations, reduces the likelihood of blending errors, and takes advantage of the compatibility and solubility characteristics afforded by the overall concentrate. Accordingly, aspects of the present application are directed to methods for reducing friction or wear in lubricant composition and/or a fuel composition.

EXAMPLES

The following examples are illustrative of exemplary embodiments of the disclosure. In these examples as well as elsewhere in this application, all parts and percentages are by weight unless otherwise indicated. It is intended that these examples are being presented for the purpose of illustration only and are not intended to limit the scope of the invention disclosed herein.

Comparative Example 1: Preparation of 3-(didodecylamino)propane-1,2-diol

A mixture of di-N-dodecylamine (10.4 grams) and glycidol (2.12 grams) were heated at 85° C. for 4 hours to give the product as a viscous oil.

Comparative Example 2: Preparation of 3-(dodecylamino)propane-1,2-diol

A mixture of dodecylamine (323.5 grams) and glycidol (136.1 grams) were heated at 85° C. for 4 hours to give the product as a viscous oil.

Comparative Example 3: Preparation of 3-(diisooctylamino)propane-1,2-diol

A mixture of diisooctylamine (125.7 grams) and glycidol (38.2 grams) were heated at 85° C. for 4 hours to give the product as a viscous oil.

Inventive Example 4: Preparation of 3-(dodecyl(methyl)amino)propane-1,2-diol

A mixture of N-methyldodecylamine (10.2 grams) and glycidol (3.9 grams) was heated at 85° C. for 4 hours to give the product as waxy solid.

Inventive Example 5: Preparation of 3-(octadecyl(methyl)amino)propane-1,2-diol

A mixture of N-methyloctadecylamine (5.1 grams) and glycidol (1.4 grams) was heated at 85° C. for 4 hours to give the product as waxy solid.

Inventive Example 6: Preparation of 3-(octyl(methyl)amino)propane-1,2-diol

A mixture of N-methyloctylamine (8.5 grams) and glycidol (4.4 grams) was heated at 85° C. for 4 hours to give the product as waxy solid.

Inventive Example 7: Preparation of 2-(dodecyl(methyl)amino)ethan-1-ol

The preparation was carried out as described in U.S. Pat. No. 3,732,312 using 54.6 grams of lauryl bromide and 65.8 grams of 2-(methylamino)ethanol to give the product as a clear oil.

Inventive Example 8: Preparation of 3-(2-hydroxydodecyl(methyl)amino)propane-1,2-diol A mixture of N-methylaminopropane-1,2-diol (5.7 grams) and 1,2-epoxydodecane (10.0 grams) were heated at 85° C. for 4 hours to give the product as a white solid.

Inventive Example 9: Preparation of 3-(2-hydroxyhexadecyl(methyl)aminopropane-1,2-diol A mixture of N-methylaminopropane-1,2-diol (4.4 grams) and 1,2 epoxyhexadecane (10.0 grams) were heated at 85° C. for 4 hours to give the product as a white solid.

Modified Sequence VIE Dynamometer Testing

Modified Sequence VIE testing was carried out using a General Motors 3.6 L (LY7) V6, 4-cycle engine. The test fuel was unleaded reference gasoline and the motor oil was a formulated SAE 0W-20 passenger car engine oil containing all of the standard engine oil components, but containing no friction modifiers. The friction modifier to be tested was solubilized in a small amount of the Sequence VIE motor oil to make a top-treat. The concentration of friction modifier in the top-treat was such that when it was added to the crankcase the concentration of friction modifier in the engine lubricant was 0.125 wt. %. The engine was operated with the baseline engine oil at 1500 rpm, a torque of 150 N-m, an oil temperature of 115° C. and a coolant temperature of 109° C. until the temperatures stabilized. The brake specific fuel consumption (BSFC) was measured for approximately one hour after stabilization. The top-treat containing the friction modifier was then added to the crankcase. Upon the addition of the top-treat, the BSFC decreased over the course of about five minutes. The engine was run until the BSFC stabilized, after which the fuel consumption was then measured for approximately one hour. The fuel economy improvement was calculated from the average BSFC before and after the addition of the friction modifier top-treat. The fuel economy increase values listed in the table were adjusted for engine hours and were based on a reference fluid that was tested periodically.

TABLE 5

| Run No. | Friction Modifier in engine oil | % Fuel Economy Increase |
|---|---|---|
| 1 | Base oil, plus no friction modifier | 0 |
| 2 | Base oil plus 3-(didodecylamino)propane-1,2-diol | 0.93 |
| 3 | Base oil plus 3-(dodecylamino)propane-1,2-diol | 1.04 |
| 4 | Base oil plus 3-(diisooctylamino)propane-1,2-diol | 0.76 |
| 5 | Base oil plus 3-(dodecyl(methyl)amino)propane-1,2-diol | 1.72 |
| 6 | Base oil plus 3-(octadecyl(methyl)amino)propane-1,2-diol | 1.58 |
| 7 | Base oil plus 3-(octyl(methyl)amino)propane-1,2-diol | 1.35 |
| 8 | Base oil plus 2-(dodecyl(methyl)amino)ethan-1-ol | 1.24 |
| 9 | Base oil plus 3-(2-hydroxydodecyl(methyl)amino)propane-1,2-diol | 1.18 |
| 10 | Base oil plus 3-(2-hydroxyhexadecyl(methyl)amino)propane-1,2-diol | 1.14 |

As shown in Table 5, the friction modifier additives according to the disclosure (Run Nos. 5-10) provided significant and unexpected fuel economy increase in a lubricant composition compared to diol compounds containing one long-chain alkyl group (Run No. 3) and two long-chain alkyl group (Run Nos. 2 and 4).

In the following examples, the friction coefficient of the additive indicated was tested in a lubricant and the lubricity of the additive was tested in a gasoline fuel containing 10 volume % ethanol. The friction tests were conducted using a high frequency reciprocating rig (HFRR) under a 4 N load with a stroke distance of 1 millimeter at 20 Hz and a temperature of 130° C. The treat rate of the additive was 0.125 wt. % in the lubricant that was used in the Sequence VIE testing. The gasoline wear tests were conducted using a HFRR rig using method ASTM D 6079 that was modified to allow testing the gasoline at a temperature of 25° C. All of the fuel compositions included the additive at 40 ppm by weight plus 250 ppm of a conventional detergent fuel additive package.

TABLE 6

| Test No. | Additive | Coefficient of friction | Wear scar Diameter (μm) in gasoline |
|---|---|---|---|
| 1 | Base formulation with no friction modifier | 0.155 | 800 |
| 2 | No. 1 plus 3-(didodecylamino)propane-1,2-diol | 0.139 | 750 |
| 3 | No. 1 plus 3-(dodecylamino)propane-1,2-diol | 0.143 | 730 |
| 4 | No. 1 plus 3-(diisooctylamino)propane-1,2-diol | 0.157 | 805 |
| 5 | No. 1 plus 3-(dodecyl(methyl)amino)propane-1,2-diol | 0.131 | 705 |
| 6 | No. 1 plus 3-(octadecyl(methyl)amino)propane-1,2-diol | 0.115 | 690 |

TABLE 6-continued

| Test No. | Additive | Coefficient of friction | Wear scar Diameter (μm) in gasoline |
|---|---|---|---|
| 7 | No. 1 plus 3-(octyl(methyl)amino)propane-1,2-diol | 0.129 | 725 |
| 8 | No. 1 plus 2-(dodecyl(methyl)amino)ethan-1-ol | 0.138 | 780 |
| 9 | No. 1 plus 3-(2-hydroxydodecyl(methyl)amino) propane-1,2-diol | 0.133 | 650 |
| 10 | No. 1 plus 3-(2-hydroxyhexadecyl(methyl)amino) propane-1,2-diol | 0.133 | 585 |

Some of the additive in the fuel is transferred into the lubricant within the piston cylinder area between the liner and the piston ring and accumulates in the lubricant in the oil sump over time. Thus, the unexpected improvement of the inventive examples in reducing the coefficient of friction as shown in Table 6 is indicative of the beneficial effect of the present invention on friction and wear in the piston ring zone as well as reducing friction in the other engine components. As shown by the foregoing results in Table 6, the additive of the inventive examples (Nos. 5-10) provided significant and unexpected friction reduction compared to the additives of Nos. 2-4. The additive of the inventive examples (Nos. 5-7 and 9-10) also provided lower wear scars compared to the additives of Nos. 2-4. While the wear scar of the inventive friction modifier (No. 8) in gasoline was comparable to the friction modifiers of Nos. 2-3, all of the inventive friction modifiers provided lower wear scar diameters in gasoline than a fuel composition devoid of the friction modifier. Overall, the friction modifier of Test No. 6 provided the lowest coefficient of friction in oil and the friction modifier of Test No. 10 provided the lowest wear scar diameter in gasoline.

It is noted that, as used in this specification and the appended claims, the singular forms "a," "an," and "the," include plural referents unless expressly and unequivocally limited to one referent. Thus, for example, reference to "an antioxidant" includes two or more different antioxidants. As used herein, the term "include" and its grammatical variants are intended to be non-limiting, such that recitation of items in a list is not to the exclusion of other like items that can be substituted or added to the listed items For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that can vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques.

While particular embodiments have been described, alternatives, modifications, variations, improvements, and substantial equivalents that are or can be presently unforeseen can arise to applicants or others skilled in the art. Accordingly, the appended claims as filed and as they can be amended are intended to embrace all such alternatives, modifications variations, improvements, and substantial equivalents.

What is claimed is:

1. A fuel composition comprising gasoline and from about 10 to about 750 ppm by weight based on a total weight of the fuel composition of a dialkylaminoalkanol of the formula $R^1(R^2)NCH_2CH(OH)R^4$ wherein $R^1$ is an alkyl group devoid of hydroxy group(s) containing from 8 to 50 carbon atoms; $R^2$ is an alkyl group contacting from 1 to 4 carbon atoms; and $R^4$ is $CH_2OH$, wherein the fuel composition is effective for reducing friction or wear and improving engine fuel economy when combusted in an engine.

2. The fuel composition of claim 1, wherein the fuel composition contains from about 120 to about 380 ppm by weight of the dialkylaminoalkanol based on a total weight of the fuel composition.

3. The fuel composition of claim 1, wherein $R^1$ is an alkyl group devoid of hydroxy group(s) containing from 8 to 20 carbon atoms and $R^2$ is a methyl group.

4. The fuel composition of claim 1, wherein the dialkylaminoalkanol comprises a compound selected from the group consisting of 3-(dodecyl(methyl)amino)propane-1,2-diol, 3-(octyl(methyl)amino)propane-1,2-diol, 3-(octadecyl (methyl)amino)propane-1,2-diol, and mixtures thereof.

* * * * *